US012623115B2

(12) United States Patent
Kim et al.

(10) Patent No.: US 12,623,115 B2
(45) Date of Patent: May 12, 2026

(54) GENERATING SYSTEM OF CLUB EXERCISE DATA BASED ON INTEGRAL MARKER AND OPERATION METHOD THEREOF

(71) Applicant: Vieworks Co., Ltd., Anyang-si (KR)

(72) Inventors: Joong Geun Kim, Hwaseong-si (KR); Seung Hyun Kim, Seongnam-si (KR); Yun Ki Kim, Daejeon (KR)

(73) Assignee: Vieworks Co., Ltd., Anyang-si (KR)

( * ) Notice: Subject to any disclaimer, the term of this patent is extended or adjusted under 35 U.S.C. 154(b) by 0 days.

(21) Appl. No.: 18/883,190

(22) Filed: Sep. 12, 2024

(65) Prior Publication Data

US 2025/0082995 A1 Mar. 13, 2025

(30) Foreign Application Priority Data

Sep. 13, 2023 (KR) ..... 10-2023-0121975

(51) Int. Cl.
*A63B 24/00* (2006.01)
*A63B 69/36* (2006.01)
*A63B 71/06* (2006.01)

(52) U.S. Cl.
CPC ..... *A63B 24/0003* (2013.01); *A63B 69/3632* (2013.01); *A63B 71/0622* (2013.01); *A63B 2071/0647* (2013.01); *A63B 2220/05* (2013.01)

(58) Field of Classification Search
CPC . A63B 24/0003; A63B 69/36; A63B 69/3632; A63B 71/0622
See application file for complete search history.

(56) References Cited

U.S. PATENT DOCUMENTS 7,828,669 B1 * 11/2010 Stites ..... A63B 53/047 473/238
2009/0270204 A1 * 10/2009 Saegusa ..... A63B 69/3614 473/409
2011/0081982 A1 * 4/2011 John ..... A63B 53/0466 473/257
2013/0190098 A1 * 7/2013 Kiraly ..... G06T 7/248 473/409
2016/0067558 A1 * 3/2016 Trahan ..... C23C 14/24 204/192.12
2023/0356039 A1 * 11/2023 Greaney ..... A63B 53/0425

FOREIGN PATENT DOCUMENTS

JP 2023-081889 A 6/2023
KR 10-2018-0040628 A 4/2018

* cited by examiner

*Primary Examiner* — Steve Rowland
(74) *Attorney, Agent, or Firm* — Bridgeway IP Law Group, PLLC; Jihun Kim

(57) ABSTRACT

Proposed are a system and method for generating club movement data. The system includes an integral marker attached to a plurality of surfaces including a first surface and a second surface of a club head, wherein a first region attached to the first surface and a second region attached to the second surface are connected, and a computing device configured to output movement data of the club head from an image of the club head on the basis of the integral marker.

15 Claims, 11 Drawing Sheets

GENERATING SYSTEM OF CLUB EXERCISE DATA BASED ON INTEGRAL MARKER AND OPERATION METHOD THEREOF

CROSS-REFERENCE TO RELATED APPLICATION

This application claims priority to and the benefit of Korean Patent Application No. 10-2023-0121975, filed on Sep. 13, 2023, the disclosure of which is incorporated herein by reference in its entirety.

BACKGROUND

1. Field of the Invention

The present disclosure relates to a system for generating club movement data on the basis of an integral marker and an operating method thereof.

2. Discussion of Related Art

Existing virtual golf systems, which are widely used to allow golfers to play golf at a low cost, may measure physical quantities associated with a golf club on the basis of the trajectory of the golf club for a ball when a golfer hits the ball, and provide simulation results to the golfer.

These existing virtual golf systems are focused on producing simulation results on the basis of ball launch data (ball speed, a ball launch angle, a ball launch direction, and a ball spin rate). In other words, existing virtual golf systems focus on a golfer hitting a ball to provide simulation results. On the other hand, there is an increasing demand for recent virtual golf systems to provide not only ball launch data but also club data that is generated during a golf swing.

Particularly, in overseas markets, golf simulators are increasingly being required to have a club data function for golf instruction and education in addition to screen golf games.

SUMMARY OF THE INVENTION

To acquire club data in an existing virtual golf system, it is necessary to attach at least two markers to a club face surface and measure physical quantities of the club. In other words, to acquire parameters for producing club data, existing virtual golf systems involve tracking at least two regions, and when any one marker falls off, accurate club data is not acquired.

According to an aspect of the present disclosure, there is provided a system for generating club exercise data, the system including an integral marker attached to a plurality of surfaces including a first surface and a second surface of a club head, wherein a first region attached to the first surface and a second region attached to the second surface are connected to each other, and a computing device configured to output movement data of the club head from an image of the club head on the basis of the integral marker.

The first region and the second region may be separated by an edge where the first surface and the second surface of the club head meet, and at least one of the first region and the second region may be formed in a shape narrowing toward the edge.

The first surface may be a club face surface, and the first region of the integral marker may be attached to a toe region of the club face surface.

The computing device may produce an image template using camera calibration data for projecting the integral marker to a two-dimensional (2D) image and a predetermined value of the integral marker.

The computing device may identify the integral marker in a 2D image by matching the image template with the image of the integral marker.

The computing device may identify the integral marker from a plurality of images simultaneously captured by a plurality of cameras capturing in different directions and convert 2D coordinates of the identified integral marker into three-dimensional (3D) coordinates on the basis of triangulation.

The computing device may generate 3D vertex coordinates including intersection coordinates of the first region and the second region of the integral marker.

The computing device may calculate normal vectors corresponding to each of the first region and the second region on the basis of the 3D vertex coordinates.

The computing device may calculate a movement speed and direction of the club as club movement data on the basis of the normal vectors that are calculated for at least one of the first region and the second region at a plurality of points in time.

The computing device may generate a vertex coordinate pair by acquiring vertex coordinates of a first-direction integral marker from an image of the club head captured by a first camera and acquiring vertex coordinates of a second-direction integral marker from an image of the club head captured by a second camera, which images the club head from a different direction than the first camera, and acquire 3D coordinates of the integral marker on the basis of the vertex coordinate pair.

According to another aspect of the present disclosure, there is provided a method of generating movement data of a club on the basis of an integral marker attached to a club head, the method including detecting one integral marker attached to the club head in an image of the club head and outputting movement data of the club head on the basis of the detected integral marker.

According to another aspect of the present disclosure, there is provided a computing device including an input unit configured to output an image of a club head and a processor configured to identify an integral marker attached to a plurality of surfaces of the club head including a first surface and a second surface in the image and output movement data of the club head, wherein a first region of the integral marker attached to the first surface and a second region of the integral marker attached to the second surface are connected to each other.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
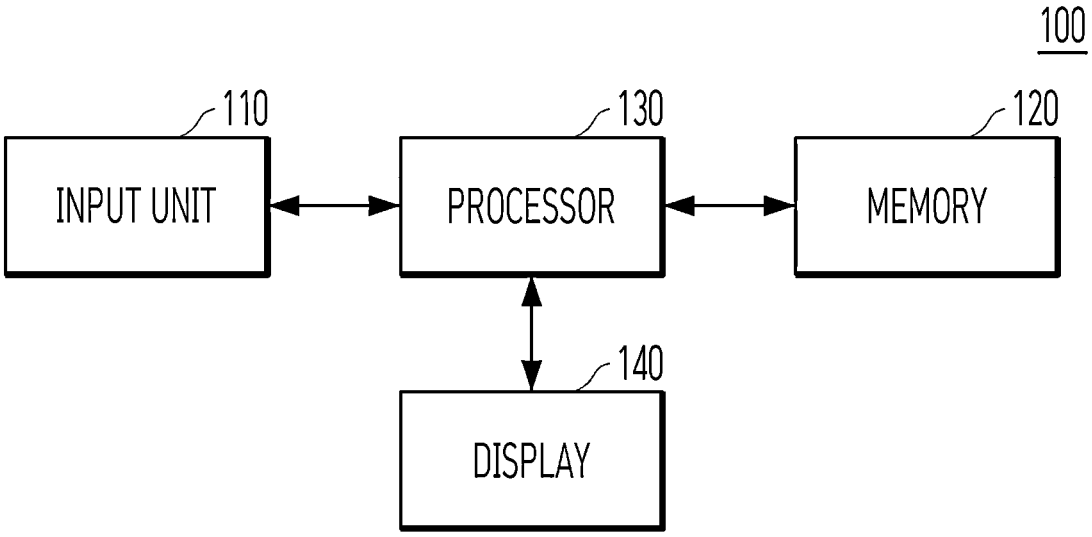
FIG. 1 is a block diagram of a computing device according to an exemplary embodiment of the present disclosure.

Specific structural and functional descriptions of embodiments are disclosed for illustrative purposes only and may be implemented in various modified forms. Accordingly, actual implementations are not limited to the specific embodiments disclosed, and the scope of this specification includes modifications, equivalents, or substitutions incorporated into the technical spirit described in the embodiments.

Terms such as "first," "second," and the like may be used to describe various components, but these terms are construed only for the purpose of distinguishing one component from others. For example, a first component may be named a second component, and similarly, a second component may be named a first component.

Singular expressions include plural expressions unless the context clearly indicates otherwise. In this specification, each of the phrases "A or B," "at least one of A and B," "at least one of A or B," "A, B, or C," "at least one of A, B, and C," and "at least one of A, B, or C" may include any one of the items listed in the phrase or all possible combinations thereof. In this specification, the terms "include," "have," and the like indicate the presence of described features, integers, steps, operations, components, parts, or combinations thereof and do not preclude the presence or addition of one or more other features, integers, steps, operations, components, parts, or combinations thereof.

When a component is referred to as being "connected to" another component, the two components may be directly coupled or connected to each other, or still another component may be interposed therebetween.

As used herein, the term "unit" refers to a software component or a hardware component, such as a field-programmable gate array (FPGA) or an application-specific integrated circuit (ASIC), and a unit performs certain functions. However, a unit is not limited to software or hardware. A unit may be configured to be in an addressable storage medium or configured to operate one or more processors. For example, a unit may include components, such as software components, object-oriented software components, class components, and task components, processes, functions, attributes, procedures, subroutines, segments of program code, drivers, firmware, microcode, circuits, data, databases, data structures, tables, arrays, and variables. Functions provided in components and units may be combined into a smaller number of components and units or subdivided into additional components and units. Further, components and units may be implemented to operate one or more central processing units (CPUs) in a device or a security multimedia card. In addition, a unit may include one or more processors.

Hereinafter, exemplary embodiments will be described in detail with reference to the accompanying drawings. In describing embodiments with reference to the accompanying drawings, like components are indicated by like reference numerals regardless of drawing number, and detailed description thereof will not be reiterated.

FIG. 1 is a block diagram of a computing device according to an exemplary embodiment of the present disclosure.

A computing device 100 may include an input unit 110, a memory 120, a processor 130, and a display 140.

The computing device 100 may be implemented as an electronic device for golf practice, an electronic device for tracking a golf swing trajectory, a laptop computer, a mobile phone, a smartphone, a tablet personal computer (PC), a mobile Internet device (MID), a personal digital assistant (PDA), an enterprise digital assistant (EDA), a digital still camera, a digital video camera, a portable multimedia player (PMP), a personal or portable navigation device (PND), a handheld game console, an e-book, or a smart device. The smart device may be implemented as a smart watch, a smart band, or a smart ring.

According to an exemplary embodiment of the present disclosure, the computing device 100 may be implemented as a device for processing a movement video. In this case, the computing device 100 may display simulation data generated on the basis of the movement video to a user through the display 140. The simulation data may be data that visualizes whether a club impacts a ball while maintaining an accurate angle, and information about an estimated distance based on a club head speed.

The input unit 110 may include devices that provide an image of a club head to the computing device 100. As an example, the input unit 110 may include a camera and a transmission device for preprocessing a captured image and then transmit the preprocessed image to the computing device 100. As another example, the input unit 110 may include an image sensor to generate an image of a club head and output the data.

However, the input unit 110 is not limited thereto and may include devices that may display a cursor on the display 140 such as a mouse, a touchscreen, a touch pen, and a trackball. In addition, the input unit 110 may include various devices that may generate an input signal from the user's manipulation such as a keyboard, a mechanical button, a microphone, and the like.

The memory 120 may be implemented as a volatile memory device or a non-volatile memory device.

The volatile memory device may be implemented as a dynamic random access memory (DRAM), a static random access memory (SRAM), a thyristor RAM (T-RAM), a zero capacitor RAM (Z-RAM), or a twin transistor RAM (TTRAM).

The non-volatile memory device may be implemented as an electrically erasable programmable read-only memory (EEPROM), a flash memory, a magnetic RAM (MRAM), a spin-transfer torque (STT)-MRAM, a conductive bridging RAM (CBRAM), a ferroelectric RAM (FeRAM), a phase change RAM (PRAM), a resistive RAM (RRAM), a nanotube RRAM, a polymer RAM (PoRAM), a nano floating gate memory (NFGM), a holographic memory, a molecular electronic memory device, or an insulator resistance change memory.

The memory 120 may store at least one method, flow, and step of the present disclosure temporarily or non-temporarily in the form of computer-readable code.

Data stored in the memory 120 may be processed by the processor 130. The processor 130 may execute computer-readable code (e.g., software) stored in the memory 120 and instructions issued by the processor 130.

The processor 130 may be a data processing device that is implemented as hardware with circuits that have a physical structure for performing desired operations. For example, the desired operations may include code or instructions included in a program.

For example, the data processing device implemented as hardware may include a microprocessor, a CPU, a processor core, a multi-core processor, a multiprocessor, an ASIC, or an FPGA.

Also, the processor 130 may be implemented as a digital signal processor (DSP) for processing digital signals, a microprocessor, or a time controller (TCON). However, the processor 130 is not limited thereto and may include one or more of a CPU, a micro-controller unit (MCU), a microprocessing unit (MPU), a controller, an application processor (AP), a communication processor (CP), and an advanced reduced instruction set computer (RISC) machine (ARM) processor or may be defined by the corresponding term. In addition, the processor 130 may be implemented as a system on chip (SoC) or large scale integration (LSI) in which a processing algorithm is embedded, and may be implemented in the form of an FPGA.

The display 140 may display various user interface objects, data, images, and videos in accordance with an exemplary embodiment of the present disclosure.

The display 140 may be implemented as various kinds of display panels. For example, the display panels may be implemented using a variety of display technologies such as a liquid crystal display (LCD), an organic light-emitting diode (OLED), an active-matrix organic light-emitting diode (AMOLED), a liquid crystal on silicon (LCoS), digital light processing (DLP), and the like. Also, the display 140 may be coupled to at least one of a front region, a side region, and a rear region in the form of a flexible display.

Meanwhile, the display 140 may be implemented in combination with a touch sensor as a touchscreen with a layered structure included in the input unit 110. The touchscreen may have not only a display function but also a function of detecting a touch input position, a touched area, and a touch input pressure. Also, the touchscreen may have a function of detecting a proximity touch as well as a real touch.

According to an exemplary embodiment of the present disclosure, the processor 130 may generate three-dimensional (3D) coordinates and a vector of the club head by analyzing images received from the input unit 110. The generated vector may be a normal vector with respect to at least one surface of the club head, and club movement data may be generated in accordance with a length change and/or directional change of normal vectors that are generated in time order. The display 140 may digitize the generated club movement data to display the digitized club movement data and may analyze the user's swing state in accordance with the club movement data to provide information such that the user may intuitively determine his or her own swing state. This will be described in detail below.

Figure 2:
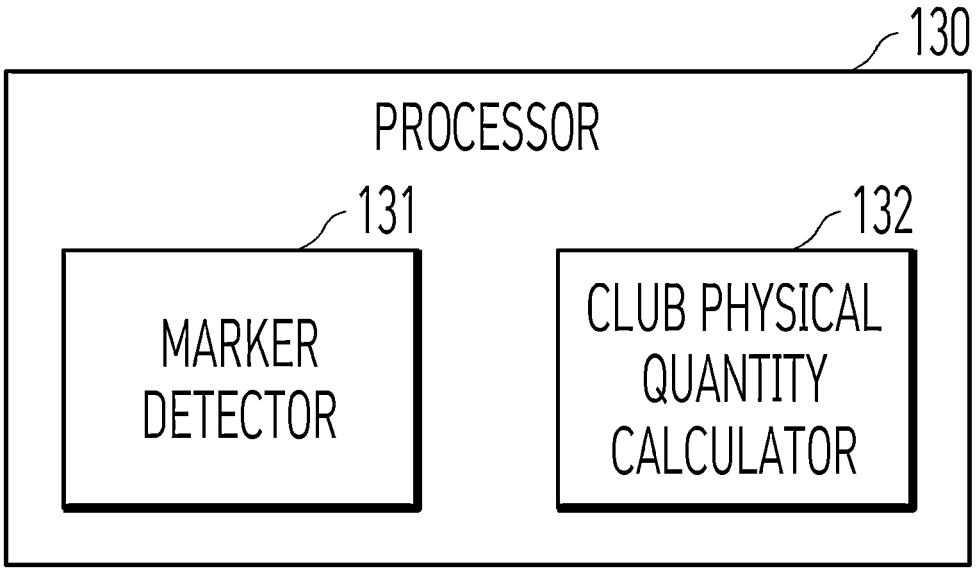
FIG. 2 is a block diagram of a processor according to an exemplary embodiment.

FIG. 2 is a block diagram of the processor 130 according to an exemplary embodiment.

Referring to FIG. 2, the processor 130 of the present disclosure may include a marker detector 131 and a club physical quantity calculator 132. The marker detector 131 and the club physical quantity calculator 132 may be components divided as software units that perform different functions. According to an embodiment, the marker detector 131 and the club physical quantity calculator 132 may be divided on the basis of types of output data.

According to an exemplary embodiment, the processor 130 may receive program data stored in the memory 120 and analyze a video input from the camera on the basis of the received program data. Here, the memory 120 may store the program data and program data corresponding to the club physical quantity calculator 132 in separate addresses, and the processor 130 may receive data required for analysis by requesting each piece of the program data from the memory 120.

The marker detector 131 may receive a video from the camera for imaging a club head and detect an integral marker in at least one frame of the received video. In this case, the marker detector 131 may separately detect a first region and a second region of the integral marker.

The club physical quantity calculator 132 may output movement data of the club head using the integral marker detected by the marker detector 131. The movement data of the club head may include a club speed, a club path, a club attack angle, a club face angle, a club lie angle, and a club loft angle. The movement data is not limited thereto and may include any type of data that is extractable from vector information acquired from at least one frame.

According to an embodiment, the club physical quantity calculator 132 may convert vertex coordinates of the integral marker into 3D space coordinates. In this case, the club physical quantity calculator 132 may receive simultaneous images from cameras that image the club head from different directions and convert two-dimensional (2D) coordinates into 3D space coordinates.

A method of outputting movement data of a club head by the processor 130 will be described below with reference to FIG. 5.

Figure 3:
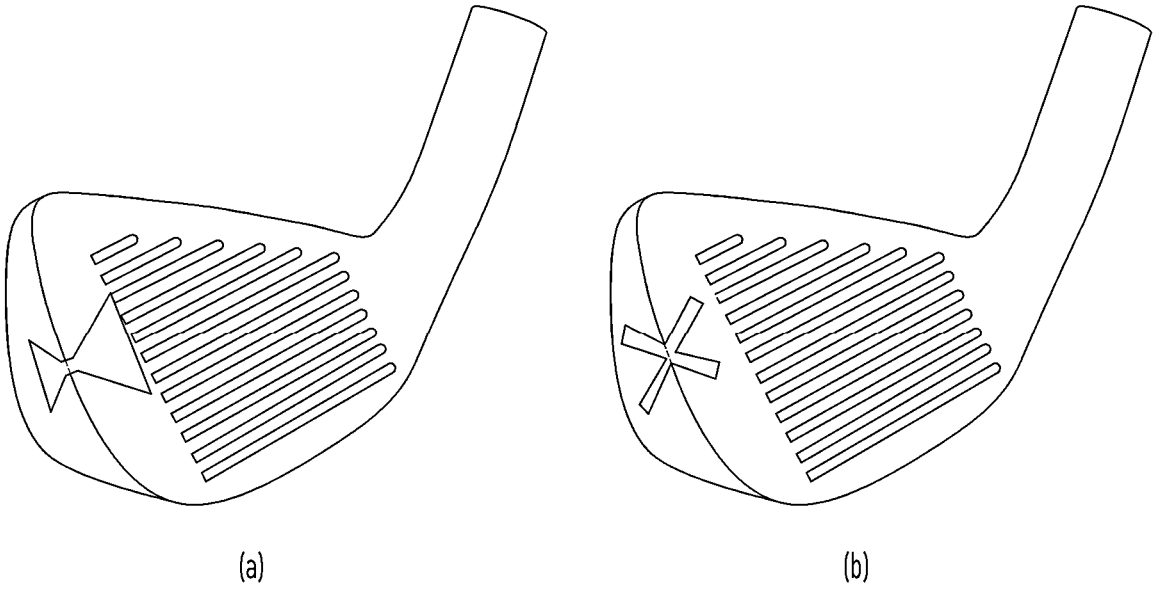
FIG. 3 is a set of diagrams showing integral markers attached to a plurality of surfaces according to exemplary embodiments.

FIG. 3 is a set of diagrams showing integral markers attached to a plurality of surfaces according to exemplary embodiments.

Referring to FIG. 3, an integral marker of the present disclosure may be implemented as an integral marker with one physical structure, thus enabling a user to avoid the hassle of attaching a plurality of markers. According to an exemplary embodiment of the present disclosure, the processor 130 may output movement data of a club head even when only one integral marker is used.

Also, the integral marker of the present disclosure may be attached to a plurality of surfaces of a club head. For example, a club head may have a plurality of surfaces including a first surface and a second surface, and a first region and a second region of the integral marker may be attached to the first surface and the second surface, respectively. The first region and the second region of the integral marker may be separated by an edge where the first surface and the second surface meet.

At least one of the first region and the second region may be formed in a shape narrowing toward the edge. For example, an integral marker according to the embodiment of FIG. 3A may be formed in a sandglass shape with two trapezoids touching each other and attached to a club head such that a bottleneck which is the narrowest portion of the sandglass shape may touch the edge. In other words, the first region and the second region may be divided by the bottleneck. An integral marker according to the embodiment of FIG. 3B may be formed in an "X" shape with a uniform thickness. Here, the first region may be configured in a shape (e.g., a ">" shape) converging in a first direction (e.g., to the right), the second region may be configured in a shape (e.g., a "<" shape) converging in a second direction (e.g., to the left) which is 180 degrees opposite to the first direction, and the integral marker may be attached to a club head such that a portion where the first and second regions meet may touch the edge.

In other words, the integral marker according to an embodiment of the present disclosure may be attached to a club head such that a plurality of surfaces of the club head may be identified. Accordingly, it is permissible for a user to attach only one integral marker to a club head such that the junction between the first region and the second region touches the edge between the first surface and the second surface, which leads to minimization of setting tasks for analyzing a club head movement.

According to an embodiment, the second region of the integral marker may be attached to a toe region of a club face surface. The club face surface may be an entire surface including a portion of the club head that impacts a ball, and the toe region of the club face surface may be the front portion of the club head. The toe region may be a region other than grooves in a stripe pattern formed with certain intervals on the club face surface.

After the second region of the integral marker is attached to the toe region of the club face surface, the first region may be attached to the side surface of the club head. Accordingly, the second region of the integral marker may be attached to identify the club face surface, and the first region may be attached to identify the side surface of the club head.

Meanwhile, unlike in the example shown in FIG. 3, the integral marker may be attached to a single surface of a club head, and the processor 130 may produce movement data of the club head using the integral marker attached to the single surface.

According to an exemplary embodiment of the present disclosure, an integral marker may include one entire object including the first region and the second region which are different from each other. In this case, a movement speed caused by a turn of the first region which is relatively far from the neck portion of the club head may be higher than a movement speed caused by a turn of the second region which is relatively close to the neck portion.

In other words, when a single integral marker divided into a first region and a second region is attached to the same surface, the processor 130 can measure different physical quantities for a region extending from the neck portion to the toe portion.

Therefore, the processor 130 can more precisely determine the amount of turn of the club head, and thus it is possible to measure physical quantities including the speed and the amount of turn of a golf ball more precisely than in a method according to the related art.

Figure 4:
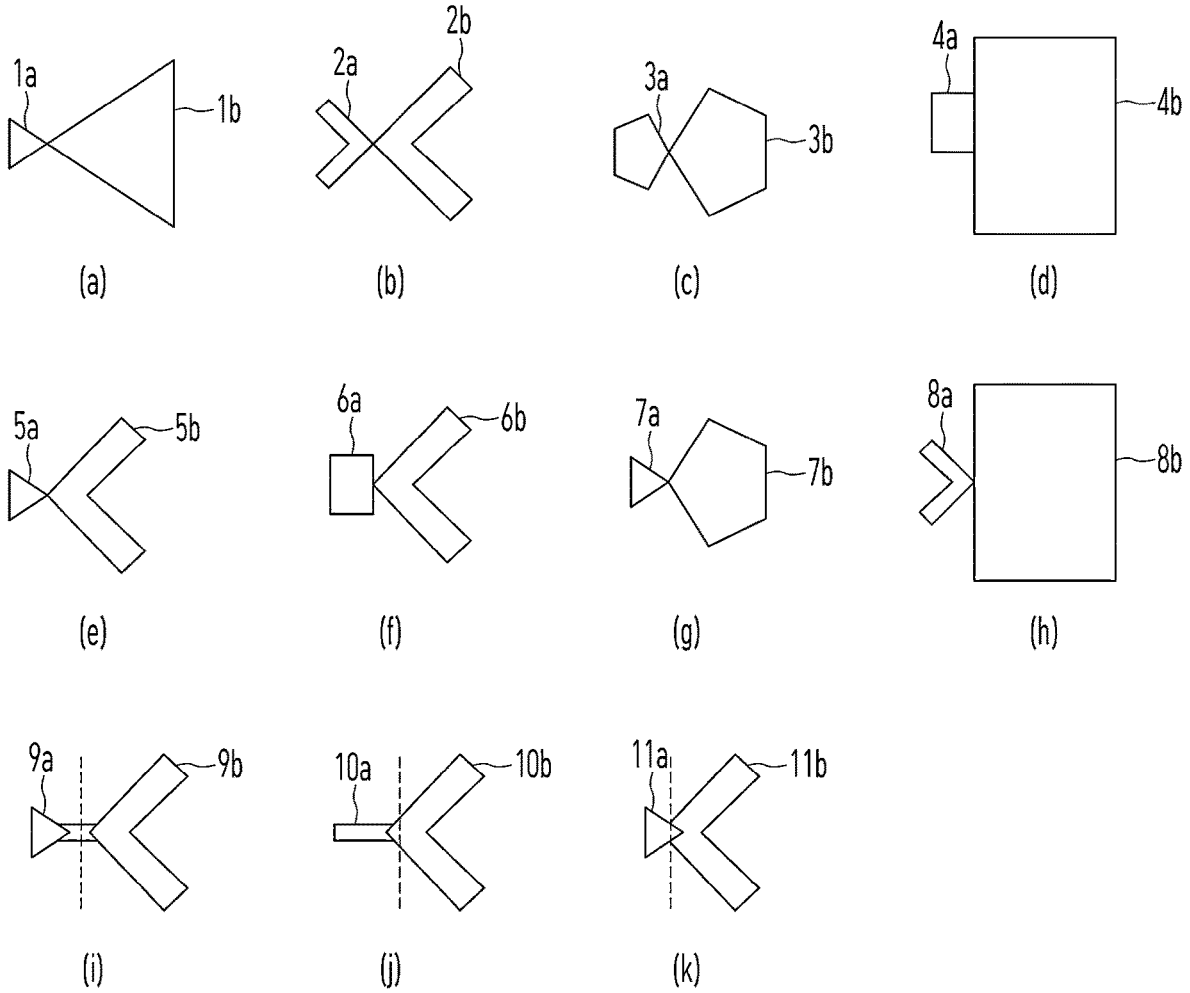
FIG. 4 is a set of diagrams showing shapes of integral markers according to a plurality of exemplary embodiments.

FIG. 4 is a set of diagrams showing shapes of integral markers according to a plurality of exemplary embodiments.

Referring to FIG. 4, a plurality of sides directed toward the edge in at least one of first regions 1*a* to 8*a* and second regions 1*b* to 8*b* may be formed in a shape converging on any one point of the edge. Although the integral markers according to the embodiments of FIG. 3 are configured to have a certain length on the edge, an integral marker of the present disclosure is not limited thereto and may be configured to have any one point on the edge.

The integral markers according to the embodiments of FIGS. 4A to 4C may be configured in a shape with one pair of triangles or pentagons meeting at any one point or an "X" shape with a ">" shape and a "<" shape meeting at any one point. The integral markers are divided into the first region and the second region on the basis of the contact point, and the first region and the second region may be configured as similar figures, that is, in the same shape but in different sizes. Here, a computing device may identify the first region and the second region of the integral markers on the basis of the size difference.

The integral markers according to the embodiments of FIGS. 4E to 4H may have first regions 5*a* to 8*a* and second regions 5*b* to 8*b* configured in different shapes. In the integral markers of FIG. 4F and FIG. 4H, only one of the first region and the second region may be configured to narrow toward the edge, and the other may be configured in a quadrangular shape. Even in this case, the first region and the second region may be configured to meet at any one point on the edge. The integral marker according to the embodiment of FIG. 4D may be configured in a shape with one pair of quadrangles in different sizes meeting at one side.

According to the embodiment of FIG. 4I, an integral marker may correspond to the embodiments of FIG. 3. In the integral marker, a connective region having a certain area may be provided to connect two regions narrowing toward the edge. Here, the first region 9*a* and the second region 9*b* may be distinguished on the basis of the edge between club surfaces.

According to the embodiments of FIGS. 4J and 4K, integral markers may be configured such that two regions do not meet at any one point on the edge but have a certain length on the edge. For example, the first region 10*a* of FIG. 4J may be configured in a "–" shape, and the second region 10*b* may be configured in a "<" shape. The first region 11*a* of FIG. 4K may be configured in a "▷" shape, and the second region 11*b* may be configured in a "<" shape.

A computing device according to the present embodiment outputs movement data of a club head on the basis of an integral marker connectively attached to a plurality of surfaces. Here, to acquire a 3D phase of the plurality of surfaces, the computing device may acquire 3D coordinates corresponding to the first region and the second region. A 3D coordinate acquisition method according to the related art involves extracting coordinates from a plurality of markers separately attached to a plurality of surfaces one by one, which takes a long time. On the other hand, a 3D coordinate acquisition method according to an embodiment of the present disclosure takes a shorter time to extract 3D coordinates because coordinates occupied by the first region and the second region can be shared.

Figure 5:
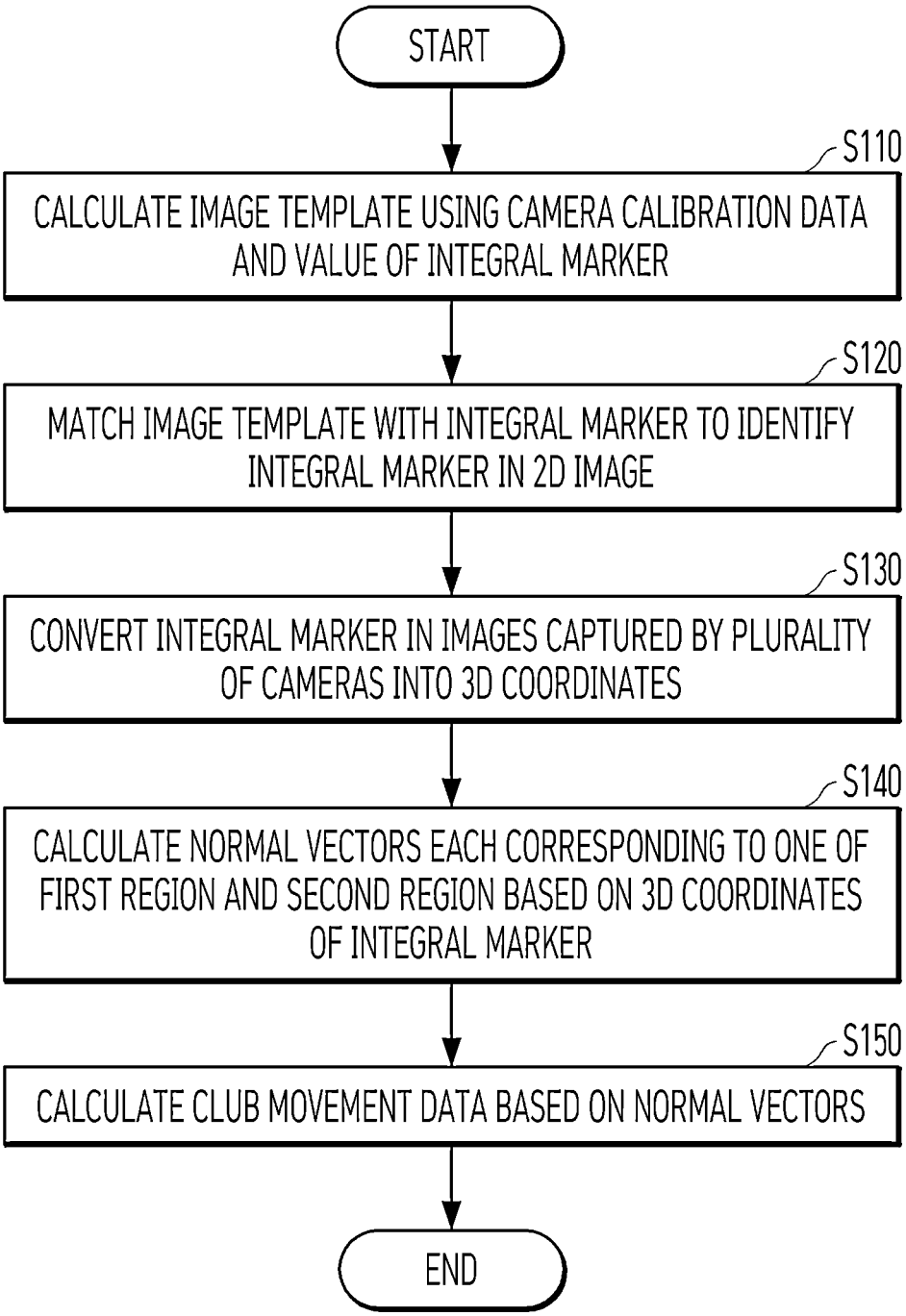
FIG. 5 is a flowchart illustrating a method of producing club movement data according to an exemplary embodiment.

FIG. 5 is a flowchart illustrating a method of producing club movement data according to an exemplary embodiment.

Referring to FIG. 5, a computing device of the present disclosure may identify an integral marker and calculate a normal vector on the basis of the identified integral marker to produce club movement data. According to an embodiment, the computing device may receive images from a plurality of cameras that image a club head from different directions and analyze the received images to produce club movement data. Here, the computing device may produce club movement data on the basis of a group of images acquired in a continuous time sequence.

In operation S110, to detect an integral marker, the computing device may produce an image template using camera calibration data and values of the integral marker. For example, the computing device may generate calibration data by checking predefined camera arrangement information from a plurality of images of a club head. Specifically, according to images of a club head captured from different directions, object images with different sizes and shapes may be generated from even the same integral marker depending on imaging directions and distances. Accordingly, the computing device may generate object scaling information of the integral marker as calibration data in accordance with the distance and angle between a camera and the club head. The object scaling information may be value adjustment information obtained by calculating how much the integral object with a preset size and shape will be distorted in terms of size and shape.

The computing device may specify a type of integral marker on the basis of a user selection and/or an integral marker identified from an image and set values of the integral marker in accordance with the specified type of integral marker. The values of the integral marker may include actual size and shape information.

According to an embodiment, the computing device may produce an image template by applying the calibration data to the values of the integral marker. The produced image template will be described in detail below with reference to FIG. 8.

In operation S120, the computing device may identify the integral marker in a 2D image by matching the image template with an integral marker. The image template may be image data that is a guideline about the integral marker preset for each camera. The computing device may identify the integral marker in accordance with the degree of matching between the image template and an integral marker and separately identify a first region and a second region of the integral marker.

According to an embodiment, the computing device may acquire images from a plurality of cameras to extract 3D coordinates of the integral marker from 2D images. In other words, the computing device may acquire images from a stereo system including two or more cameras for imaging a club head from different directions. For example, the computing device may extract 3D coordinates of the integral marker from cameras for simultaneously imaging a club head from different directions and detect a movement of the club head on the basis of a set of continuous images captured at time intervals by each camera. Here, the movement of the club head may be produced as club movement data.

In operation S130, the computing device may convert the integral marker in the images captured by the plurality of cameras into 3D coordinates. The computing device may acquire vertex coordinates of the identified integral marker for each camera. The computing device may calculate 3D coordinates of the integral marker using the vertex coordinates acquired from the plurality of cameras and calibration data of each camera on the basis of triangulation. The 3D coordinates of the integral marker may include at least three vertex coordinates. A method of calculating 3D coordinates of an integral marker on the basis of triangulation will be described in detail below with reference to FIGS. 9 to 11.

In operation S140, the computing device may calculate normal vectors each corresponding to one of the first region and the second region on the basis of the 3D coordinates of the integral marker. For example, the computing device may extract a planar vector and a normal vector of each of the first region and the second region on the basis of three or more vertex coordinates calculated for each of the first region and the second region. Here, some of the vertex coordinates of the first region and the second region may overlap. For example, coordinates of at least one point on the boundary line between the first region and the second region or a contact point of the first region and the second region may be shared. A method of generating a normal vector by a computing device will be described below with reference to FIGS. 10 and 11.

In operation S150, the computing device may produce club movement data on the basis of the normal vectors. The club movement data may include a club speed, a club path, a club attack angle, a club face angle, a club lie angle, and a club loft angle. The computing device may generate visualization information on the basis of the club movement data. The visualization information may include any type of data that is providable through a display such that a user may intuitively check a swing state.

Figure 6:
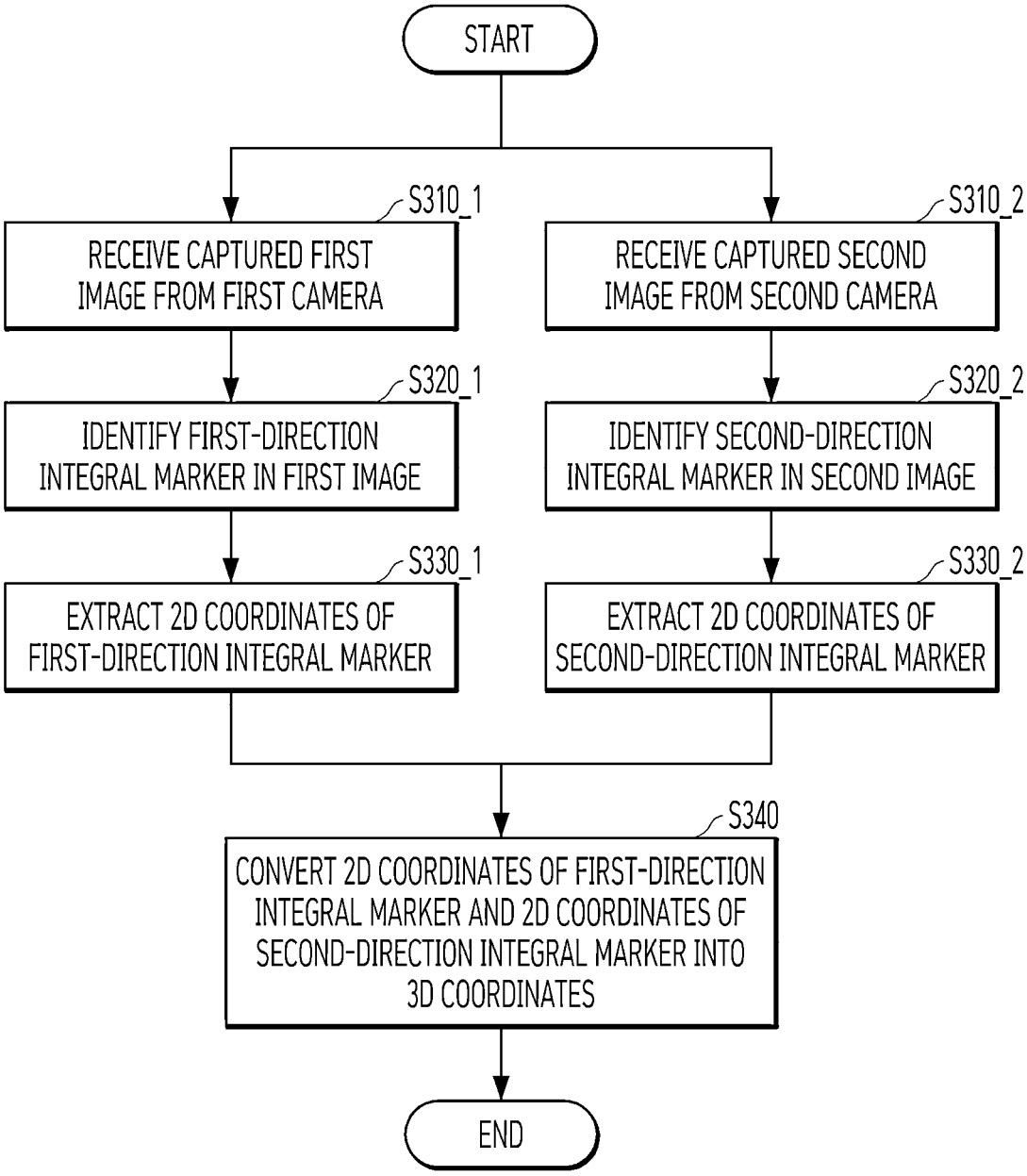
FIG. 6 is a flowchart illustrating a method of acquiring three-dimensional (3D) coordinates by extracting coordinates of an integral marker from a plurality of cameras according to an exemplary embodiment.
Figure 7A:
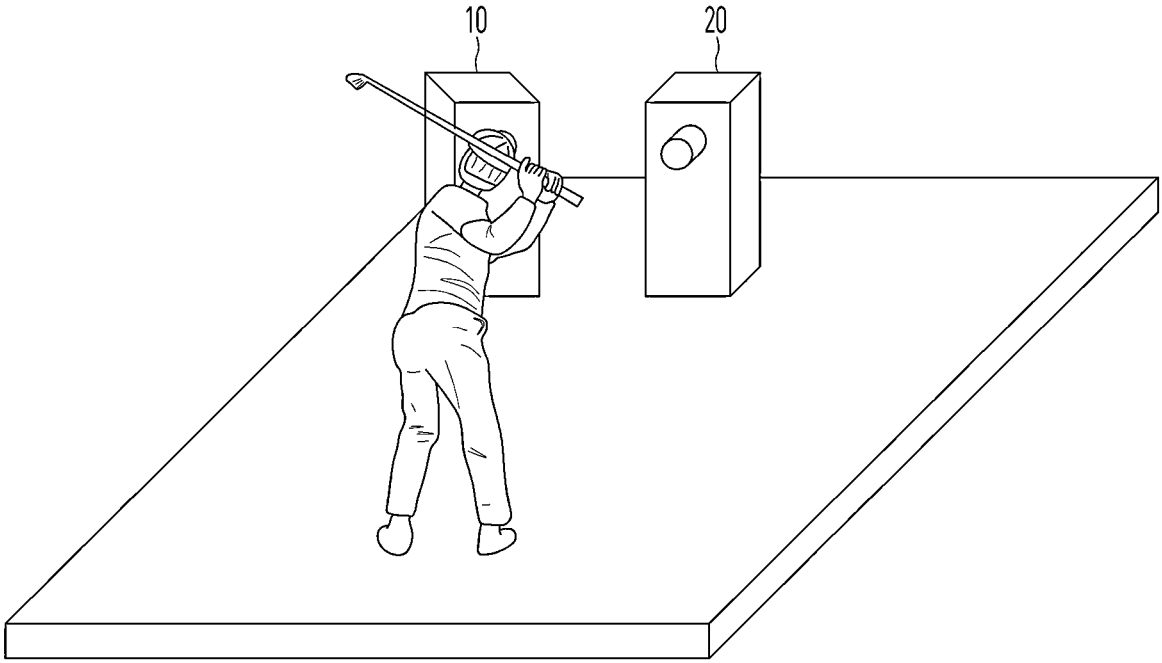
FIGS. 7A and 7B are a set of views of capturing environments for acquiring images of a club head according to an exemplary embodiment.
Figure 7B:
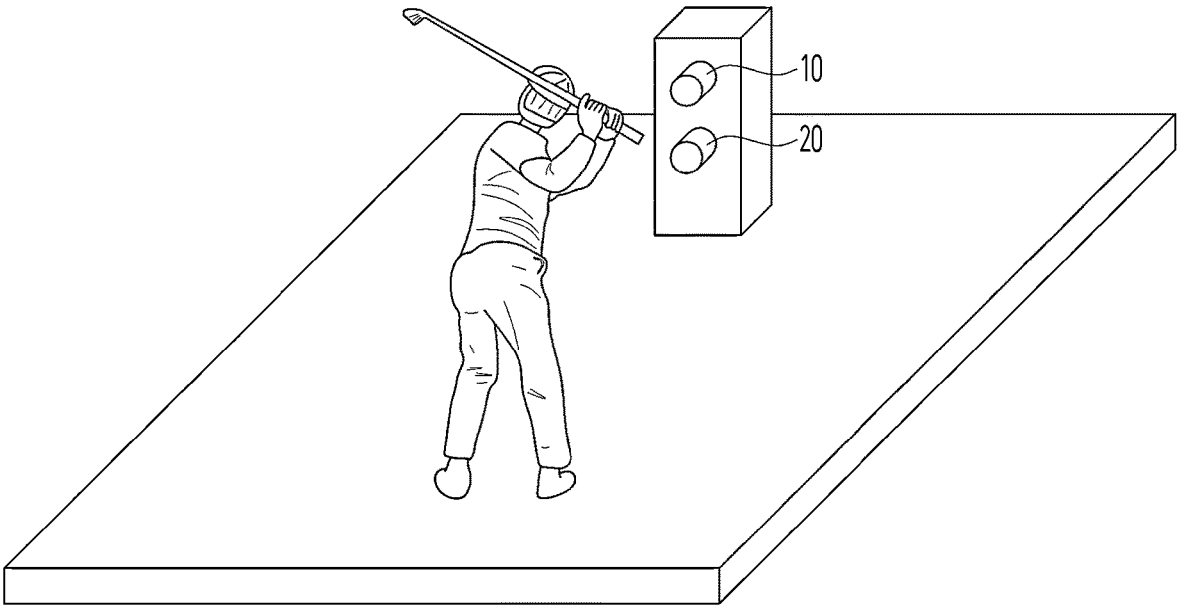

FIG. 6 is a flowchart illustrating a method of acquiring three-dimensional (3D) coordinates by extracting coordinates of an integral marker from a plurality of cameras according to an exemplary embodiment, and FIGS. 7A and 7B are a set of views of capturing environments for acquiring images of a club head according to a plurality of exemplary embodiments.

A first camera and a second camera employed in the embodiment of FIG. 6 may be described on the basis of a first camera 10 and a second camera 20 of FIGS. 7A and 7B. Referring to FIGS. 7A and 7B, at least two cameras may be used for imaging a user and a club head, and the cameras may image a club head from different directions. The cameras according to the embodiments of FIGS. 7A and 7B are described as cameras that are fixed on the floor to image a user. However, camera locations and fixtures are not limited thereto, and any type of camera that may be fixed at a certain location, such as ceiling camera fixed to the ceiling and the like, may be used.

Referring to FIG. 7A, a stereo camera system of the present disclosure may image a club head from different directions of the left and right. On the other hand, referring to FIG. 7B, the stereo camera system may image a club head from different directions of the above and below. In other words, in the stereo camera system of the present disclosure, a direction in which a plurality of cameras are spaced apart from each other is not limited to any one direction.

The computing device may receive a captured first image from the first camera 10 in operation S310_1 and may receive a captured second image from the second camera 20 in operation S310_2. The computing device may receive the first image and the second image respectively from the first camera 10 and the second camera 20 using individual methods, store the first image and the second image in a separate storages, and analyze the images in parallel.

The computing device may identify a first-direction integral marker in the first image in operation S320_1 and identify a second-direction integral marker in the second image in operation S320_2. The first-direction integral marker and the second-direction integral marker actually correspond to the same object but may be objects in images that are generated due to distortion based on imaging directions and distances of cameras. The computing device may acquire the degree of distortion of an object in advance in accordance with at least one of installation heights and angles of the first camera 10 and the second camera 20 and minimize distorted identification of an integral marker on the basis of an image template to which calibration data is applied.

The computing device may extract 2D coordinates of the first-direction integral marker in operation S330_1 and extract 2D coordinates of the second-direction integral marker in operation S330_2. The extracted 2D coordinates may be coordinate values obtained by applying calibration parameters corresponding to the cameras to coordinate values of the first- and second-direction integral markers simultaneously imaged by the cameras and identified. According to an embodiment, the computing device may use at least some 2D coordinates extracted from a first region as 2D coordinates extracted from a second region. In the case of extracting 2D coordinates of the second region, the computing device may use the previously extracted coordinates, which can reduce a time required for extracting coordinates.

In operation S340, the computing device may convert the 2D coordinates of the first-direction integral marker and the 2D coordinates of the second-direction integral marker into 3D coordinates. The computing device may generate a vertex coordinate pair from vertex coordinates corresponding to the first-direction integral marker and the second-direction integral marker and convert the vertex coordinate pair into coordinates in a 3D space.

Figure 8:
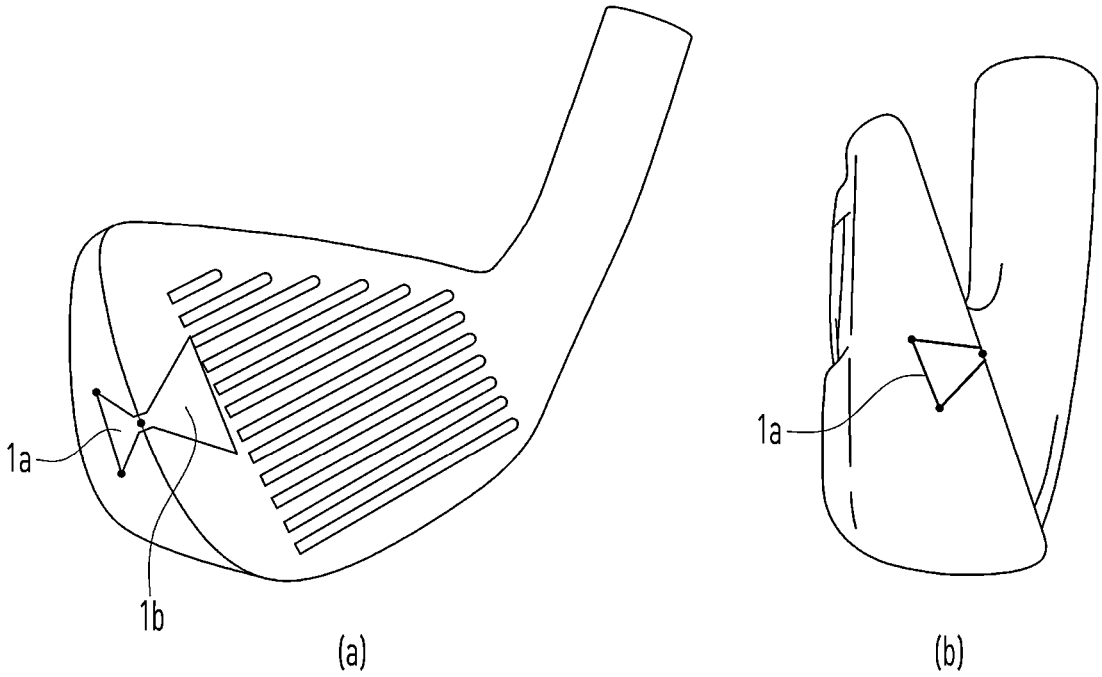
FIG. 8 is a set of images of a club head captured from different directions according to an exemplary embodiment.

FIG. 8 is a set of images of a club head captured from different directions according to an exemplary embodiment.

Referring to FIGS. 6 to 8, the captured image of FIG. 8A may be a club head image captured by the first camera 10, and the captured image of FIG. 8B may be a club head image captured by the second camera 20. As an example, FIGS. 8A and 8B may show a scene captured by the first camera 10 before the club head hits a golf ball, and a scene captured by the second camera 20 disposed under the first camera 10 when the club head hits the golf ball, respectively. As another example, the first camera 10 images a club head in front of the second camera 20 and thus may identify a club face surface to be larger than that identified by the second camera 20. Even when the club head is imaged at the same time, the second camera 20 may identify a side surface of the club head to be larger than that identified by the first camera 10.

A first region 1*a* of an integral marker identified by the first camera 10 and the second camera 20 actually has a fixed shape and size but may be imaged in different shapes and sizes in accordance with the imaging angles and distances of the first camera 10 and the second camera 20. To identify shapes and sizes differently imaged by cameras, a computing device may generate an image template using calibration data reflecting imaging angles and distances of the cameras.

Figure 9:
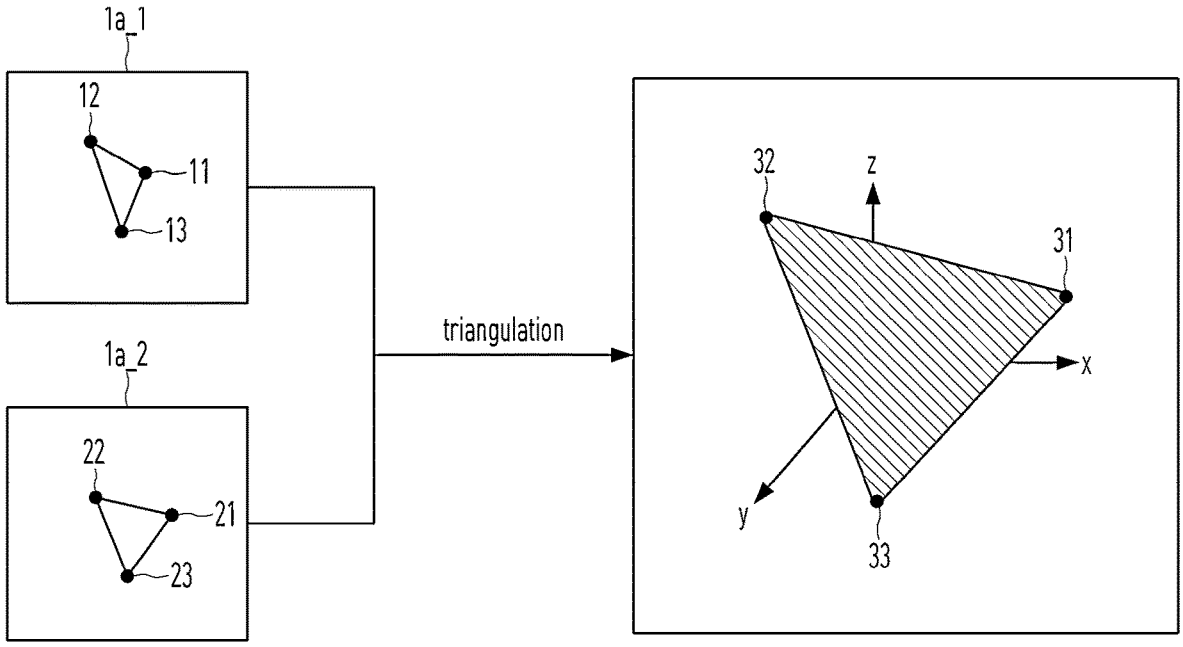
FIG. 9 is a diagram illustrating a method of acquiring 3D coordinates on the basis of a plurality of two-dimensional (2D) coordinates.

FIG. 9 is a diagram illustrating a method of acquiring 3D coordinates on the basis of a plurality of 2D coordinates.

Referring to FIG. 9, a computing device may extract a first-direction integral marker 1*a*_1 from a first camera and extract a second-direction integral marker 1*a*_2 from a second camera. Specifically, when an integral marker is identified as a triangle, the computing device may extract vertex coordinates 11 to 13 of the triangle from the first-direction integral marker 1*a*_1 and extract vertex coordinates 21 to 23 of the triangle from the second-direction integral marker 1*a*_2.

The computing device may generate a coordinate pair from vertex coordinates corresponding to the first-direction integral marker 1*a*_1 and the second-direction integral marker 1*a*_2. For example, the computing device may generate a first coordinate pair (11, 21), a second coordinate pair (12, 22), and a third coordinate pair (13, 23).

The computing device may convert the coordinate pairs into 3D coordinates 31 to 33 on the basis of triangulation. The coordinate values 11 to 13 of the first-direction integral marker 1*a*_1 may be 2D coordinate values obtained by projecting the integral marker object in a first direction, and the coordinate values 21 to 23 of the second-direction integral marker 1*a*_2 may be 2D coordinate values obtained by projecting the integral marker object in a second direction. The computing device may calculate an essential matrix on the basis of the geometric relationship between the first camera and the second camera and generate 3D coordinates of the integral marker using a method of generating 3D coordinates by applying an essential matrix used in triangulation to corresponding coordinates of stereo images.

Figure 10:
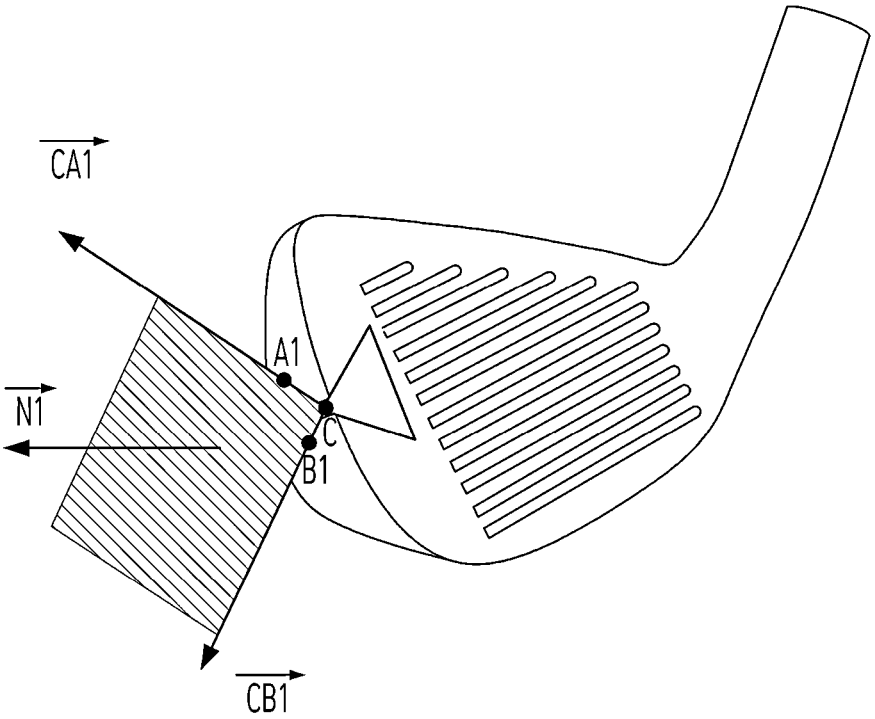
FIGS. 10 and 11 are diagrams illustrating a method of acquiring normal vectors of a first surface and a second surface of a club head.
Figure 11:
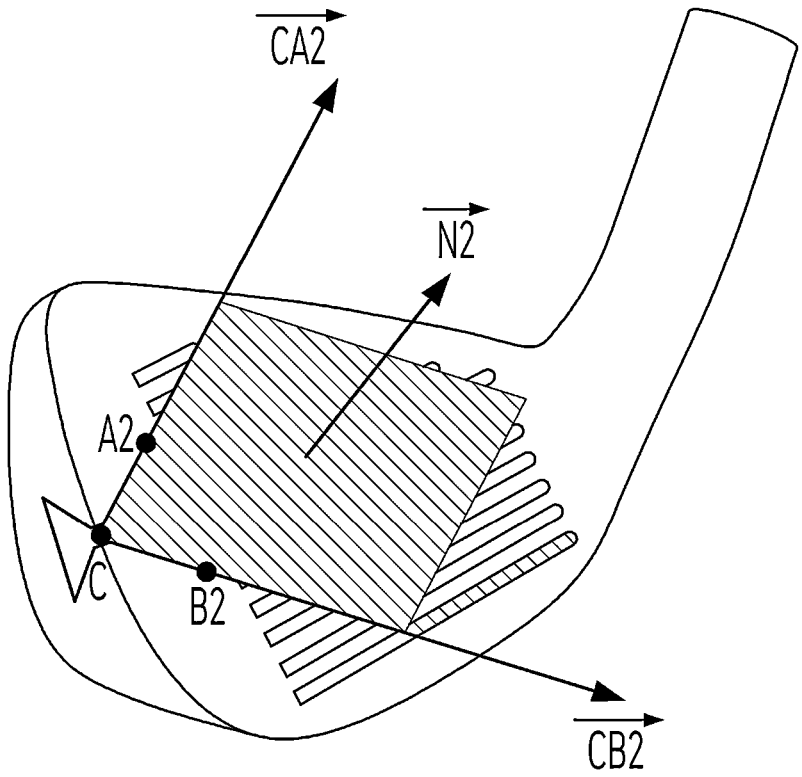

FIGS. 10 and 11 are diagrams illustrating a method of acquiring normal vectors of a first surface and a second surface of a club head.

Referring to FIG. 10, a computing device may calculate 3D coordinates of a first region and calculate a normal vector of the first region on the basis of the 3D coordinates. When three 3D coordinates are calculated from the first region, the computing device may calculate two vectors $\overrightarrow{CA1}$ and $\overrightarrow{CB1}$ that connect any one point C to two other points A1 and B1, respectively. The computing device may calculate a normal vector $\overrightarrow{N1}$ for the first region by calculating a cross product of the two vectors.

Referring to FIG. 11, the computing device may calculate 3D coordinates of a second region, and may calculate a normal vector of the second region on the basis of the 3D coordinates. When three 3D coordinates are calculated from the second region, the computing device may calculate two vectors $\overrightarrow{CA2}$ and $\overrightarrow{CB2}$ that connect any one point C to two other points A2 and B2, respectively. The computing device may calculate a normal vector $\overrightarrow{N2}$ for the second region by calculating a cross product of the two vectors.

The computing device of the present disclosure may generate a normal vector for at least one of the first region and the second region using the above method and generate club movement data on the basis of the normal vector. For example, club movement data may be generated from an angle of a club face surface upon impact on the basis of the normal vector of the club face surface.

In addition, the computing device may acquire a state of change of normal vectors from a group of images acquired in a continuous time sequence and estimate a club path in accordance with the state of change of the normal vectors. However, a method in which the computing device acquires club movement data on the basis of normal vectors is not limited thereto.

A system for generating club movement data according to the technical spirit of the present disclosure employs an integral marker and thus can produce club movement data using only one marker. Also, it is possible to improve a customer's satisfaction by excluding as many parts that may hinder swinging as possible.

In addition, since the integral marker is attachable to a plurality of surfaces of a club head, the system can be used in both ceiling and floor golf simulators with different camera positions, which improves compatibility with golf simulators.

The above-described embodiments may be implemented by hardware components, software components, and/or combinations thereof. For example, the devices, method, and components described in the embodiments may be implemented using a general-use computer or a special-purpose computer such as a processor, a controller, an arithmetic logic unit (ALU), a digital signal processor, a microcomputer, an FPGA, a programmable logic unit (PLU), a microprocessor, or any other device which may execute instructions and respond. A processing device may execute an operating system (OS) or software applications running the OS. Also, the processing device may access, store, manipulate, process, and generate data in response to execution of software. Although one processing device is described as being used in some cases for convenience of understanding, it will be understood by those of ordinary skill in the art that the processing device may include a plurality of processing elements and/or a plurality of types of processing elements. For example, the processing device may include a plurality of processors or one processor and one controller. Also, the processing device may have a different processing configuration such as a parallel processor.

Software may include computer programs, codes, instructions or a combination of one or more thereof and may configure a processing device to operate in a desired manner or may independently or collectively control the processing device. Software and/or data may be permanently or temporarily embodied in any type of machine, component, physical equipment, virtual equipment, computer storage medium or device, or transmitted signal waves to be interpreted by the processing device or to provide instructions or data to the processing device. Software may be distributed throughout computer systems connected via a network and may be stored or executed in a distributed manner. Software and data may be recorded on one or more computer-readable storage media.

Methods according to embodiments may be implemented in the form of program instructions which are executable by one or more processors (e.g., 130) of various computing devices, and may be recorded on a non-transitory computer-readable recording medium. The computer-readable recording medium may store program instructions, data files, data structures, and the like alone or in combination, and program instructions recorded on the medium may be designed and configured especially for embodiments or known and available to those skilled in computer software. Examples of the computer-readable recording medium include magnetic media, such as a hard disk, a floppy disk, and magnetic tape, optical media, such as a compact disc (CD)-ROM and a digital versatile disc (DVD), magneto-optical media, such as a floptical disk, and hardware devices that are specially configured to store and perform program instructions. Examples of the program instructions include both machine code produced by a compiler and high-level code that may be executed by a computer using an interpreter or the like.

The foregoing hardware devices may be configured to operate as one or more software modules to perform operations of embodiments, and vice versa.

Although embodiments have been described above with the limited drawings, those of ordinary skill in the art may apply various technical modifications and variations to the embodiments. For example, appropriate results can be achieved even when the described techniques are executed in a different order from the described method and/or components of the described system, structure, device, circuit, and the like are coupled or combined in a different form from the described method or replaced or substituted by other components or equivalents.

Therefore, other implementations, other embodiments, and equivalents of the claims fall within the scope of the following claims.

What is claimed is:

1. A system for generating club movement data, the system comprising:

an integral marker attached to a plurality of surfaces including a first surface and a second surface of a club head, wherein the first surface is on a different plane than the second surface, and wherein a first region attached to the first surface is in direct contract with a second region attached to the second surface; and a computing device configured to output movement data of the club head from an image of the club head based on the integral marker, wherein the first region and the second region are divided by an edge where the first surface and the second surface of the club head meet, and wherein at least one of the first region and the second region is formed in a shape narrowing toward the edge.

2. The system of claim 1, wherein the first surface is a club face surface, and the first region of the integral marker is attached to a toe region of the club face surface.

3. The system of claim 1, wherein the computing device produces an image template using camera calibration data for projecting the integral marker to a two-dimensional (2D) image and a predetermined value of the integral marker.

4. The system of claim 3, wherein the computing device identifies the integral marker in a 2D image by matching the image template with the image of the integral marker.

5. The system of claim 4, wherein the computing device identifies the integral marker from a plurality of images simultaneously captured by a plurality of cameras capturing from different directions and converts 2D coordinates of the identified integral marker into three-dimensional (3D) coordinates based on triangulation.

6. The system of claim 1, wherein the computing device generates three-dimensional (3D) vertex coordinates including intersection coordinates of the first region and the second region of the integral marker.

7. The system of claim 6, wherein the computing device calculates normal vectors each corresponding to one of the first region and the second region based on 3D vertex coordinates.

8. The system of claim 7, wherein the computing device calculates a movement speed and direction of the club head as club movement data based on the normal vectors that are calculated for at least one of the first region and the second region at a plurality of points in time.

9. The system of claim 6, wherein the computing device generates a vertex coordinate pair by acquiring vertex coordinates of a first-direction integral marker from an image of the club head captured by a first camera and acquiring vertex coordinates of a second-direction integral marker from an image of the club head captured by a second camera, which images the club head from a different direction than the first camera, and acquires 3D coordinates of the integral marker based on the vertex coordinate pair.

10. A method of generating movement data of a club based on an integral marker attached to a club head, the method comprising:

detecting the integral marker attached to the club head in an image of the club head; and outputting movement data of the club head based on the detected integral marker, wherein the integral marker includes a first region which is in direct contact with a second region, wherein the first region and the second region are attached to a first surface and a second surface of the club head, respectively, wherein the first surface is on a different plane than the second surface, wherein the first region and the second region are divided by an edge where the first surface and the second surface of the club head meet, and wherein at least one of the first region and the second region is formed in a shape narrowing toward the edge.

11. The method of claim 10, wherein the detecting of the integral marker comprises:

calculating an image template using camera calibration data for projecting the integral marker to a two-dimensional (2D) image and a predetermined value of the integral marker; and identifying the integral marker in a 2D image by matching the image template with the image of the integral marker.

12. The method of claim 11, wherein the identifying of the integral marker comprises identifying the integral marker from a plurality of images simultaneously captured by a plurality of cameras capturing from different directions, and the outputting of the movement data comprises:

converting 2D coordinates of the identified integral marker into three-dimensional (3D) coordinates based on triangulation;

calculating normal vectors each corresponding to one of the first region and the second region based on the 3D coordinates; and producing club movement data based on the normal vectors.

13. The method of claim 12, wherein the producing of the club movement data comprises calculating a movement speed and direction of the club as club movement data based on the normal vectors that are calculated for at least one of the first region and the second region at a plurality of points in time.

14. The method of claim 12, wherein the identifying of the integral marker comprises:

acquiring vertex coordinates of a first-direction integral marker from an image of the club head captured by a first camera;

acquiring vertex coordinates of a second-direction integral marker from an image of the club head captured by a second camera which images the club head from a different direction than the first camera; and acquiring 3D coordinates of the integral marker based on a vertex coordinate pair matching the vertex coordinates.

15. A computing device comprising:

an input unit configured to output an image of a club head; and a processor configured to identify an integral marker, which is attached to a plurality of surfaces of the club head including a first surface and a second surface, in the image and output movement data of the club head, wherein the first surface is on a different plane than the second surface, wherein a first region of the integral marker attached to the first surface is in direct contact with a second region of the integral marker attached to the second surface, wherein the first region and the second region are divided by an edge where the first surface and the second surface of the club head meet, and wherein at least one of the first region and the second region is formed in a shape narrowing toward the edge.

* * * * *